US007866234B2

(12) United States Patent
Smart et al.

(10) Patent No.: US 7,866,234 B2
(45) Date of Patent: Jan. 11, 2011

(54) MANUAL CORE ROTATION DEVICE

(75) Inventors: Lucky L. Smart, Peebles, OH (US); John B. Howard, West Union, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/839,084

(22) Filed: Aug. 15, 2007

(65) Prior Publication Data

US 2009/0044665 A1 Feb. 19, 2009

(51) Int. Cl.
*B25B 17/00* (2006.01)
*G01M 15/00* (2006.01)

(52) U.S. Cl. ..... 81/57.3; 73/112.01

(58) Field of Classification Search ..... 81/57.3, 81/57.43, 58.1, 74, 64; 415/118, 122.1; 73/116.03, 73/168, 112.01
See application file for complete search history.

(56) References Cited

U.S. PATENT DOCUMENTS

| | | | | | |
|---|---|---|---|---|---|
| 1,866,714 | A | * | 7/1932 | King | 408/127 |
| 2,073,903 | A | | 3/1937 | O'Neil | |
| 2,511,049 | A | | 6/1950 | Coldwell | |
| 2,637,233 | A | * | 5/1953 | Hoffman | 81/57.43 |
| 2,787,180 | A | * | 4/1957 | Fish | 81/57.29 |
| 2,814,224 | A | * | 11/1957 | Allard | 81/57.43 |
| 2,817,988 | A | * | 12/1957 | Stahl | 81/73 |
| 3,138,397 | A | * | 6/1964 | Griffiths | 81/473 |
| 3,696,694 | A | * | 10/1972 | Boro | 81/57.27 |
| 4,141,262 | A | * | 2/1979 | Smith | 81/57.39 |
| 4,215,601 | A | * | 8/1980 | Mann | 81/57.13 |
| 4,876,929 | A | | 10/1989 | Kozak | |
| 4,913,007 | A | * | 4/1990 | Reynolds | 81/57.29 |
| 4,920,832 | A | * | 5/1990 | Van Gennep | 81/57.29 |
| 5,355,751 | A | * | 10/1994 | Specht | 81/57.14 |
| 5,638,726 | A | * | 6/1997 | Pelkonen et al. | 81/57.43 |
| 5,647,254 | A | * | 7/1997 | Cook, Jr. | 81/475 |
| 5,697,269 | A | | 12/1997 | Tseng | |
| 5,741,965 | A | * | 4/1998 | Hernandez et al. | 73/112.01 |
| 5,813,829 | A | * | 9/1998 | Mazzotta | 415/123 |
| 6,260,451 | B1 | | 7/2001 | Mirabito | |
| 7,107,884 | B2 | * | 9/2006 | Cutler et al. | 81/479 |
| 2005/0204877 | A1 | * | 9/2005 | Royko | 81/479 |
| 2006/0260323 | A1 | * | 11/2006 | Moulebhar | 60/793 |
| 2007/0031242 | A1 | * | 2/2007 | Colonna et al. | 415/121.3 |
| 2007/0130767 | A1 | * | 6/2007 | McCooey et al. | 29/889.2 |

FOREIGN PATENT DOCUMENTS

| | | | |
|---|---|---|---|
| DE | 2639151 | A1 | 3/1978 |
| DE | 4338748 | A1 | 5/1995 |
| FR | 2841166 | A | 12/2003 |
| GB | 2394523 | A | 4/2004 |

OTHER PUBLICATIONS

Include copy of this form with next communication to applicant. Efs Web 2.1.17.

* cited by examiner

*Primary Examiner*—David B Thomas
(74) *Attorney, Agent, or Firm*—William Scott Andes; General Electric Company

(57) ABSTRACT

A device for manually rotating a core of a gas turbine engine, said device comprising a drive mechanism, an operator control, and a flexible cable rotatably coupling said drive mechanism and said operator control.

7 Claims, 4 Drawing Sheets

MANUAL CORE ROTATION DEVICE

BACKGROUND OF THE INVENTION

The technology described herein relates generally to gas turbine engine components and more specifically to devices for manually rotating the core of a gas turbine engine.

Gas turbine engines typically include a compressor, a combustor, and at least one turbine. The compressor may compress air, which may be mixed with fuel and channeled to the combustor. The mixture may then be ignited for generating hot combustion gases, and the combustion gases may be channeled to the turbine. The turbine may extract energy from the combustion gases for powering the compressor, as well as producing useful work to propel an aircraft in flight, such as by driving a fan or propeller, or to power a load, such as an electrical generator.

The compressor and turbine are linked together via a shaft to form a rotating piece of turbomachinery located inside of a casing. This assembly may be referred to as a "core" of the gas turbine engine. During maintenance or repair operations it is often necessary to inspect blades and other elements of this rotating turbomachinery within the core. However, access to and visibility of this turbomachinery is frequently limited by the casing as well as other elements of the gas turbine engine.

Many gas turbine engines have one or more inspection ports, openings in the casing, which may be opened via removable plugs or covers to inspect and/or service (repair, replace, adjust, etc.) internal components. Inspection can be visual with the naked eye, or with mirrors or other optical tools such as borescopes. Frequently, however, these inspection ports are positioned such that only certain elements of the rotating turbomachinery are visible with the engine stopped and the turbomachinery in a fixed position. It is therefore often necessary to rotate the turbomachinery to view and/or service other components.

Rotation is typically accomplished by applying torque through a drive pad which is connected to an accessory gearbox. A socket is normally provided in the drive pad to receive a ratchet wrench or other hand tool, or an output shaft of a motorized drive unit. Manual operation of the drive pad, however, may prove difficult for an operator who needs to be proximate to an inspection port which may not be adjacent to the drive pad. Therefore, two or more persons may be required to rotate and inspect or service the turbomachinery. Motorized drive units may be operated remotely by an operator who is proximate the inspection port. However, motorized drive units are expensive, often cumbersome, and do not provide the operator with a "feel" for the rotation and momentum of the turbomachinery, making precise positioning and/or reversing of the rotation somewhat difficult and time consuming.

Accordingly, there remains a need for a device for manually rotating or turning a core of a gas turbine engine which is inexpensive yet portable and easy to use, and enables a single operator to rotate and inspect or service the turbomachinery.

BRIEF DESCRIPTION OF THE INVENTION

A device for manually rotating a core of a gas turbine engine, said device comprising a drive mechanism, an operator control, and a flexible cable rotatably coupling said drive mechanism and said operator control.

DETAILED DESCRIPTION OF THE INVENTION

Figure 1:
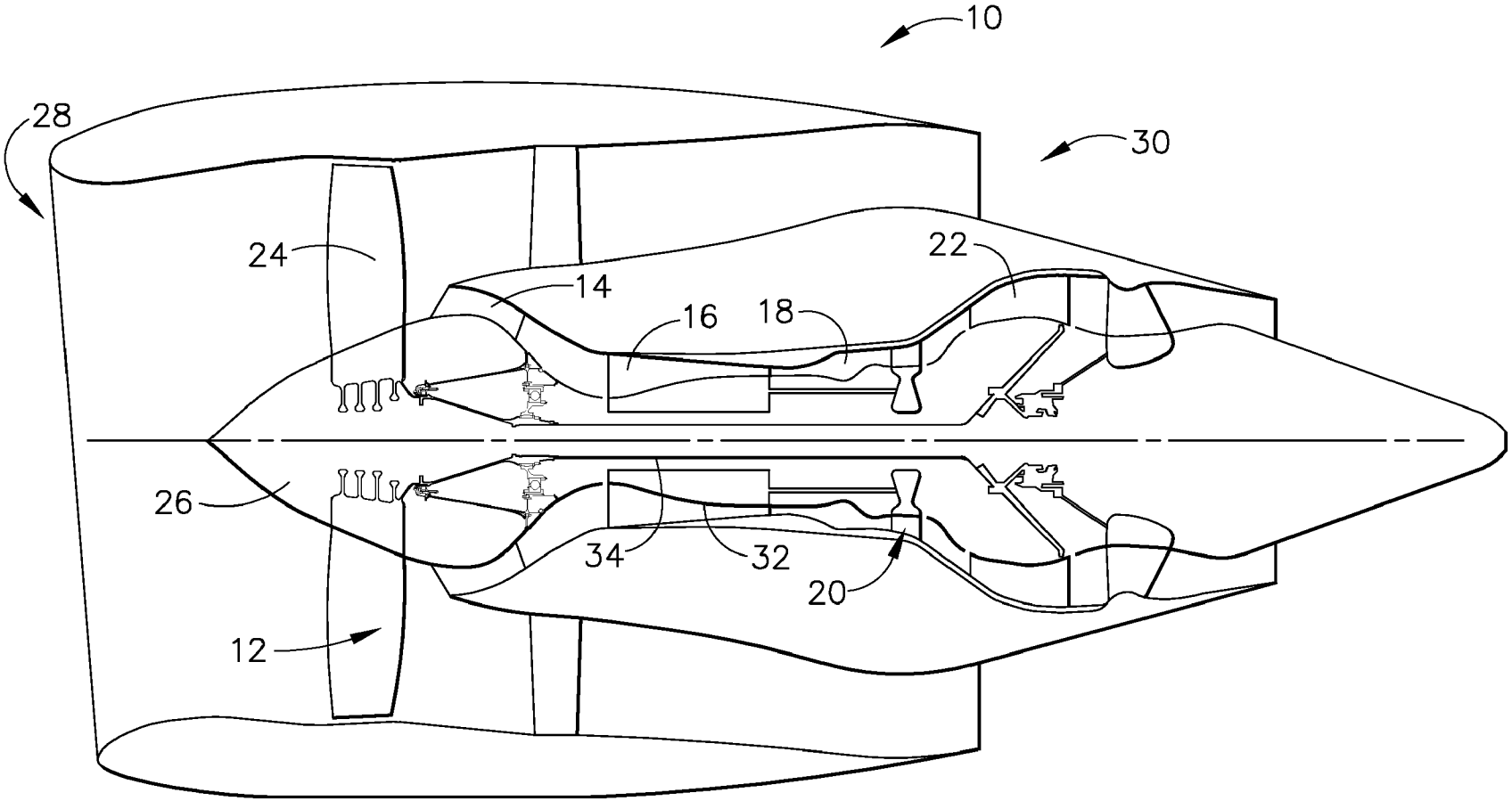
FIG. 1 is a cross-sectional schematic view of an exemplary gas turbine engine.

FIG. 1 is a schematic illustration of an exemplary gas turbine engine 10 including a fan assembly 12, a booster 14, a high pressure compressor 16, and a combustor 18. The engine 10 also includes a high pressure turbine 20, and a low pressure turbine 22. The fan assembly 12 includes an array of fan blades 24 extending radially outward from a rotor disk 26. The engine 10 has an intake side 28 and an exhaust side 30. The engine 10 may be any gas turbine engine. For example, the engine 10 may be, but is not limited to being, a GE90 gas turbine engine available from General Electric Company, Cincinnati, Ohio. The fan assembly 12, booster 14, and turbine 22 may be coupled by a first rotor shaft 32, and the compressor 16 and turbine 20 may be coupled by a second rotor shaft 34.

In operation, air flows through the fan assembly 12 and compressed air is supplied to the high pressure compressor 16 through the booster 14. The highly compressed air is delivered to the combustor 18, where it is mixed with a fuel and ignited to generate combustion gases. The combustion gases are channeled from the combustor 18 to drive the turbines 20 and 22. The turbine 22 drives the fan assembly 12 and booster 14 by way of shaft 32. The turbine 20 drives the compressor 16 by way of shaft 34. High pressure compressor 16, turbine 20, and shaft 34 form a rotating piece of turbomachinery sometimes called a core which may require inspection and/or service from time to time. This turbomachinery is enclosed within an outer casing 70 (identified in FIG. 2).

Figure 2:
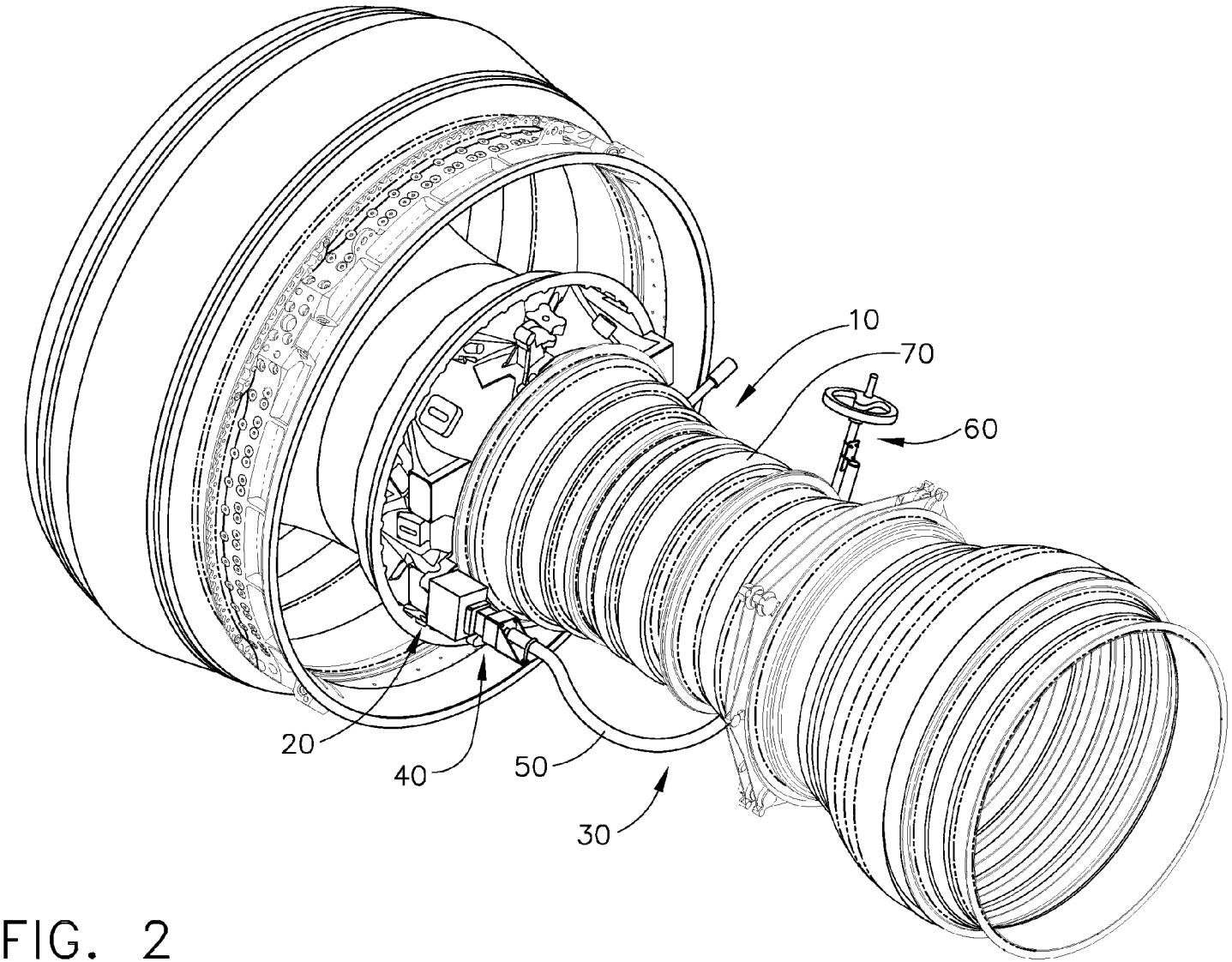
FIG. 2 is a perspective view of an exemplary gas turbine engine having a manual core rotation device installed thereon.

As shown in FIG. 2, engine 10 includes a drive pad 20 which provides a mechanical drive connection to the rotating turbomachinery through a gearbox (not labeled). Gearbox and drive pad locations may vary in location and orientation depending upon the particular engine application. Also shown in FIG. 2 is an exemplary manual device 30 for turning the core. Manual core turning device 30 includes a drive mechanism 40, a flexible drive cable 50, and an operator control 60.

Figure 3:
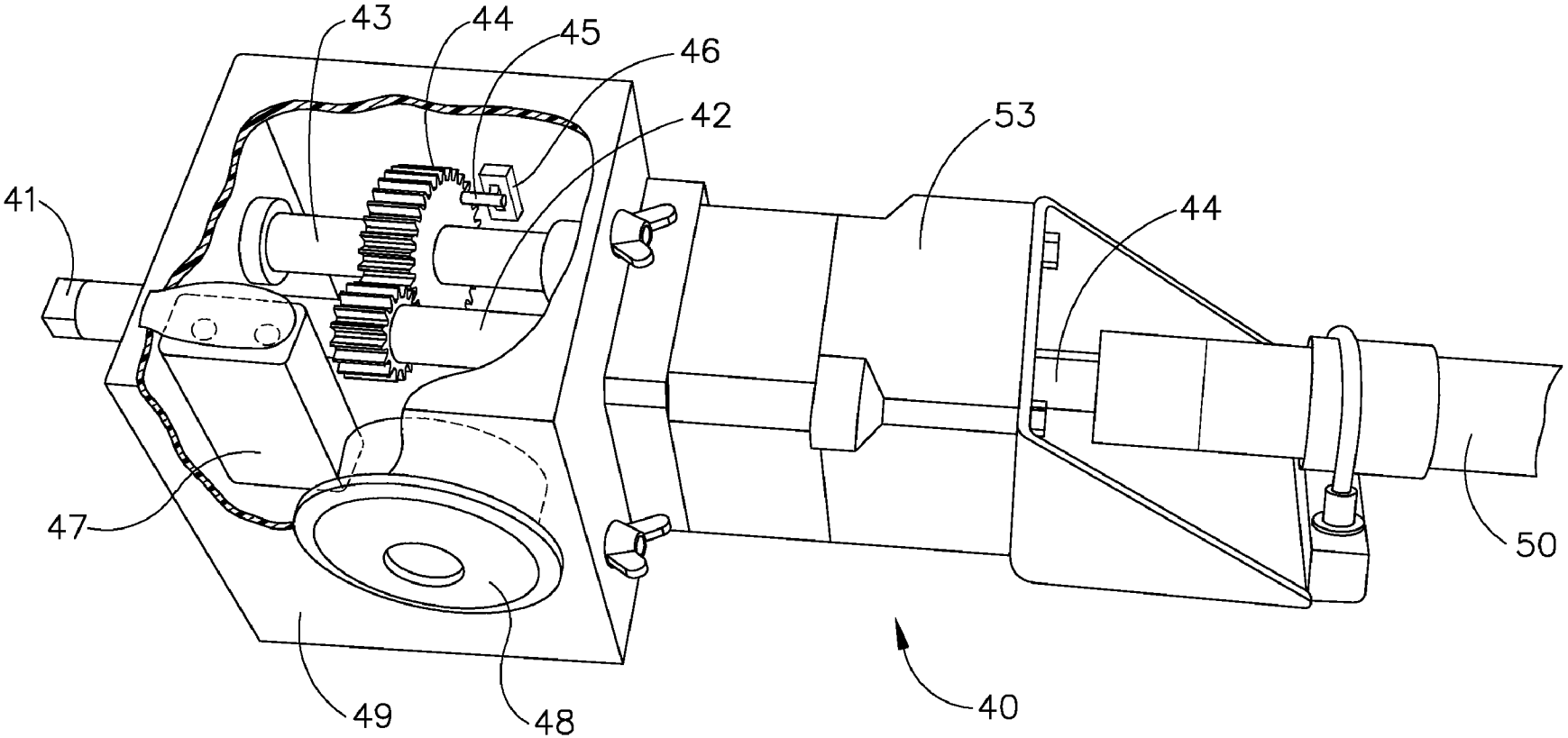
FIG. 3 is a partial cut-away view of an exemplary drive mechanism of a manual core rotation device.

FIG. 3 illustrates in greater detail the elements of the drive mechanism 40. Drive mechanism 40 includes a coupling feature 41, an output shaft 42, a mounting block 49, a planetary gearbox 53, and an input shaft 44.

In operation, input shaft 44 receives torque from flexible cable 50, transmits torque through planetary gearbox 53 through mounting block 49 to output shaft 42 and to the drive pad 20 via coupling feature 41 to rotate the turbomachinery within the core of the engine 10.

As show in FIG. 3, additional elements may be included to enhance the operation of the manual core rotation device such as an enunciator to signal rotational position of the engine. Output shaft 42 may be coupled to a secondary shaft 43 through gearset 44 having a suitable gear ratio to rotate secondary shaft 43 one rotation per rotation of the core of the engine 10. A pin 45 affixed to gearset 44 can be utilized to engage a microswitch 46 to send electric current from battery 47 to an sound emitter 48 and thereby provide an audible indication that the core had undergone a complete rotation (and thus inspection from a fixed reference point would have inspected all rotating elements circumferentially disposed around the core).

Battery 47, microswitch 46, and sound emitter 48 may be of any suitable design and construction, and may be commercially available items. Battery 47 may be a dry cell battery and sound emitter 48 may be a bell, buzzer, or horn of suitable sound production characteristics so as to be readily heard by the operator in the desired location. Other locations for the enunciator are possible, such as proximate to the operator control, so long as the enunciator provides a desired indication of the engine rotation.

Planetary gearbox 53 may provide any desired gear ratio between the output shaft 42 and the input shaft 44. Having a gear ratio such that one turn of the input shaft 44 produces less than a full rotation of output shaft 42 may reduce the level of manual effort required to rotate the core and also enable finer control over the rotational position of the core for inspection and/or service operations. Ratios of 10 to 1 may be useful for certain engine applications, and may be specified so as to achieve a desired level of operator effort to rotate the core, such as approximate values on the order of 80 inch pounds. Higher (numerically) gear ratios may be needed for larger engines to reduce the rotational effort required.

Mounting block 49 may be of any suitable size, shape, material, and construction for mating the output shaft 42 and coupling 41 to the drive pad 20 of the engine 10. It may be desirable to fabricate the mounting block 49 from, or coat mounting block 49 with, a non-stick and non-marring material such as tetrafluoroethylene or polytetrafluoroethylene, which is commercially available under the trade name TEFLON® from DuPont. Mounting block 49 may have any suitable mounting configuration, such as holes or slots to engage complementary features on the engine 10 to hold the drive mechanism in place and may utilize bolts or screws for securement.

Figure 4:
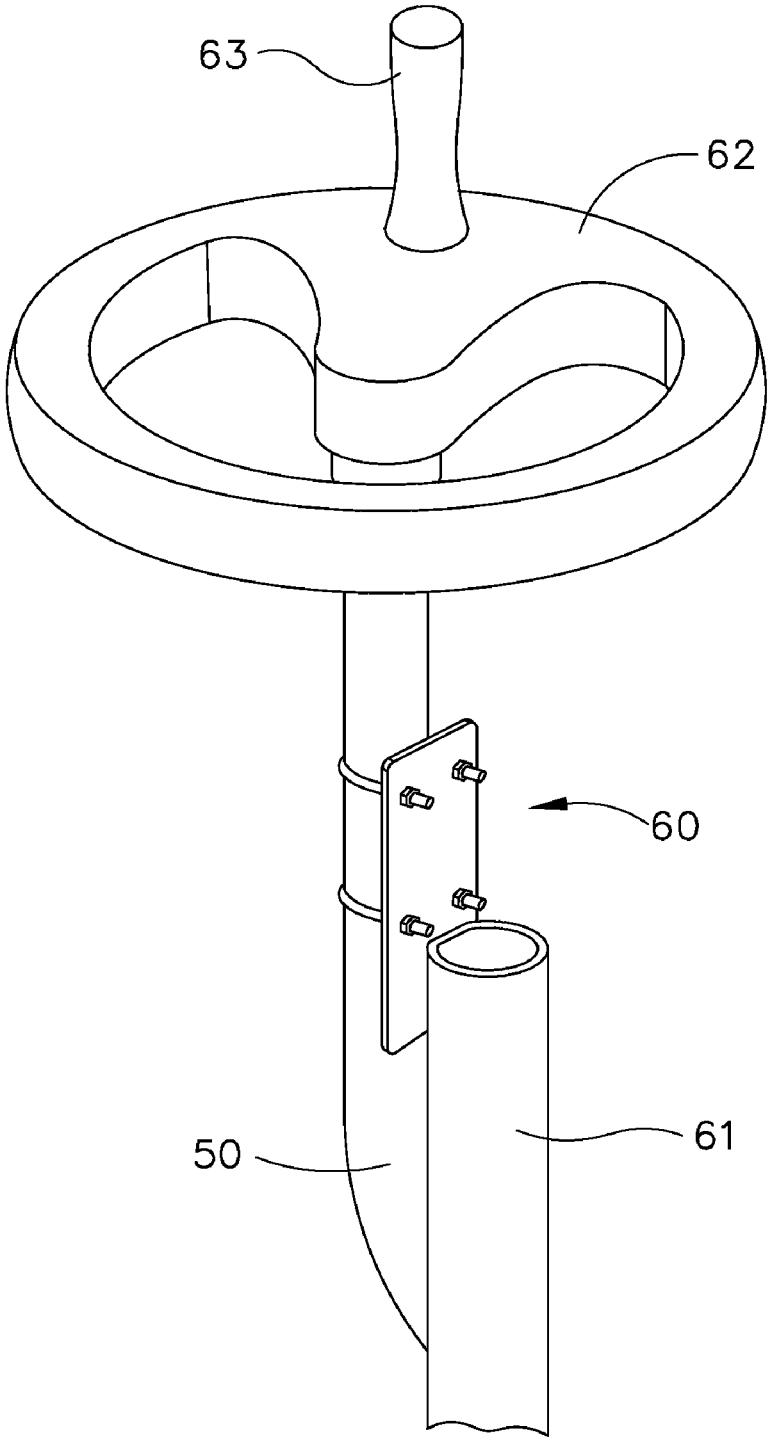
FIG. 4 is a perspective view of an exemplary operator control of a manual core rotation device.

As shown in FIG. 4, the operator control 60 includes a mounting device 61 and a wheel type device 62 for controlling the rotation of the core. The wheel 62 also includes a knob 63 to provide for increased operator control over the rotation of the wheel 62. The wheel 62 is affixed to the flexible cable 50 through any suitable conventional coupling. Although a wheel 62 is shown, any type of device may be provided for operator use or, if desired, a tool engagement feature may be provided such that the operator can use a conventional tool such as a ratchet wrench.

Mounting device 61 can be of any conventional construction suitable for securing operator control 60 in a fixed position, such as affixed to the gas turbine engine, an engine holding fixture, an engine accessory or element such as a pipe or tube, or an engine nacelle or pylon (if the engine is serviced on the aircraft). Clamps or brackets may be used as required to hold the operator control, and may provide for adjustment or movement to another location as required. The operator control may be positioned as desired by the operator to provide for ease of rotation and control of rotation, as well as visibility to the inspection ports or other items the operator needs to view or operate such as service or repair tooling.

Elements of the manual core rotation device may be fabricated from any suitable materials, and may incorporate standard commercially-available items or materials as desired. In particular, the cable may be any type of flexible cable which is suitable in length and flexibility for the intended application. Spring cables as well as solid cables may be suitable for this low speed, comparatively low torque application.

The manual core rotation device may also be provided as an assembly in kit form, with one or more different mounting blocks adapted to be used with various engines and engine configurations. A carrying case may be provided for ease of storage and transportation of the device. The device may be self-contained, without requiring any external power supply or support equipment, and therefore provides a high degree of portability. It may also be suitable for use in a wide range of internal and external operating environments, and may be fabricated so as to be weather resistant as well.

Manual core rotation devices of the type described herein may be useful in other installations besides gas turbine engines. For example, such devices may be utilized in the automotive field or any other field where it is desired to rotate machinery from a remote location. With regard to gas turbine engines, applications may include aircraft type applications as well as land based or marine applications.

While this application has described various specific exemplary embodiments, those skilled in the art will recognize that those exemplary embodiments can be practiced with modification within the spirit and scope of the claims.

What is claimed is:

1. A device for manually rotating a core of a gas turbine engine, said device comprising:

a) a manual drive mechanism, said drive mechanism including a coupling feature adapted to engage a drive pad of said engine and a mounting block adapted to secure said coupling feature to said drive pad;

b) an operator control, said operator control including a mounting device suitable for securing said operator control in a fixed position remote from but rotatably coupled to said drive mechanism; and c) a flexible cable rotatably coupling said drive mechanism and said operator control.

2. The device of claim 1 wherein said drive mechanism includes a planetary gearbox.

3. The device of claim 1 wherein said operator control includes a wheel.

4. The device of claim 1 wherein said drive mechanism includes an enunciator.

5. A method for manually rotating a core of a gas turbine engine, said method comprising the steps of:

a) securing a manual drive mechanism to said engine, said drive mechanism including a coupling feature adapted to engage a drive pad of said engine and a mounting block adapted to secure said coupling feature to said drive pad;

b) securing an operator control in a fixed location positioned as desired by the operator which is remote from but rotatably coupled to said drive mechanism; and c) operating said operator control to manually rotate said engine.

6. The method of claim 5 further comprising the step of visually inspecting said engine.

7. The method of claim 5 further comprising the step of performing a service operation on said engine.

* * * * *